United States Patent [19]

Kocher et al.

[11] 4,421,006

[45] Dec. 20, 1983

[54] MANUAL COCKING DEVICE FOR AN AUTOMATIC FIRING WEAPON

[75] Inventors: Willi Kocher, Zurich; Jakob Zimmermann, Pfäffikon, both of Switzerland

[73] Assignee: Werkzeugmaschinenfabrik Oerlikon-Bürle AG, Zurich, Switzerland

[21] Appl. No.: 325,906

[22] Filed: Nov. 30, 1981

[30] Foreign Application Priority Data

Dec. 18, 1980 [CH] Switzerland ..... 9341/80

[51] Int. Cl.[3] ..... F41D 11/00; F41F 19/16

[52] U.S. Cl. ..... 89/1 K

[58] Field of Search ..... 89/1 K

[56] References Cited

U.S. PATENT DOCUMENTS

| | | | |
|---|---|---|---|
| 2,408,110 | 9/1946 | Thresh | 89/1 K |
| 2,845,001 | 7/1958 | Hillberg | 89/1 K |
| 3,386,336 | 6/1968 | Roy | 89/1 K |

FOREIGN PATENT DOCUMENTS

| | | | |
|---|---|---|---|
| 289053 | 2/1914 | Fed. Rep. of Germany | 89/1 K |
| 721590 | 6/1942 | Fed. Rep. of Germany | 89/1 K |
| 954824 | 12/1956 | Fed. Rep. of Germany | 89/1 K |
| 489550 | 1/1954 | Italy | 89/1 K |
| 963119 | 7/1964 | United Kingdom | 89/1 K |
| 1255924 | 12/1971 | United Kingdom | 89/1 K |

*Primary Examiner*—David H. Brown

*Attorney, Agent, or Firm*—Werner W. Kleeman

[57] ABSTRACT

A manual cocking device or charger contains an entrainment element operatively connected to a weapon breechblock and movable by means of a tensioning or cocking chain. A sprocket wheel engages with the cocking or tensioning chain and is driven by means of a handcrank which can be fitted onto a drive shaft. For avoiding a premature advance of the breechblock and eliminating the danger of injury to the gun operator by the handcrank, a locking wheel is rigidly mounted for rotation upon the drive shaft. This locking wheel is arrested by means of a locking pin or bolt in a rotational sense which is opposite to the drive rotational direction. The handcrank is axially aligned upon the drive shaft by means of a safety bolt. By means of a common holder or support the locking bolt and the safety bolt can be simultaneously disengaged upon termination of the cocking operation.

5 Claims, 7 Drawing Figures

MANUAL COCKING DEVICE FOR AN AUTOMATIC FIRING WEAPON

BACKGROUND OF THE INVENTION

The present invention relates to a new and improved construction of manual cocking device or charger for an automatic firing weapon.

Generally speaking, the manual cocking device or charger of the present development is of the type comprising an entrainment element which is movable by means of a cocking or tensioning chain for retracting a breechblock against the force of its forwardly advancing means thereof. A sprocket wheel engages with the cocking or tensioning chain and is operatively connected to a drive shaft which is driven by a removable handcrank.

A weapon cocking device or charger of this type has become known to the art from Swiss Pat. No. 459,000. This device is associated with the disadvantage that in the event of a possibly premature release of the handcrank, i.e. before the breechblock has been caught in its rearmost position by the trigger, the breechblock is prematurely forwardly accelerated and the gun operator thereby endangered, not least by the rapidly rotating handcrank.

SUMMARY OF THE INVENTION

Therefore, it is a primary object of the present invention to provide a new and improved construction of cocking device for an automatic firing weapon which is not afflicted with the aforementioned drawbacks and shortcomings of the prior art, Another and more specific object of the present invention is to provide a new and improved construction of manual cocking device or charger for an automatic firing weapon which is easy to operate and eliminates the danger of a premature forward movement or advance of the breechblock.

Now in order to implement these and still further objects of the invention, which will become more readily apparent as the description proceeds, the manual cocking device or charger for an automatic firing weapon as contemplated by the invention is manifested by the features that a locking wheel is mounting upon the drive shaft. Operatively associated with the locking wheel is a spring-loaded locking bolt which serves to block the locking wheel for movement in a predetermined direction of rotation. The handcrank is axially secured at the drive shaft by means of a safety bolt. A common holder or support serves to bring the locking bolt and the safety bolt out of engagement with the locking wheel and the handcrank, respectively.

BRIEF DESCRIPTION OF THE DRAWINGS

The invention will be better understood and objects other than those set forth above will become apparent when consideration is given to the following detailed description thereof. Such description makes reference to the annexed drawings which illustrate an exemplary embodiment of manual cocking device constructed according to the invention and wherein.

DETAILED DESCRIPTION OF THE PREFERRED EMBODIMENTS

Figure 1:
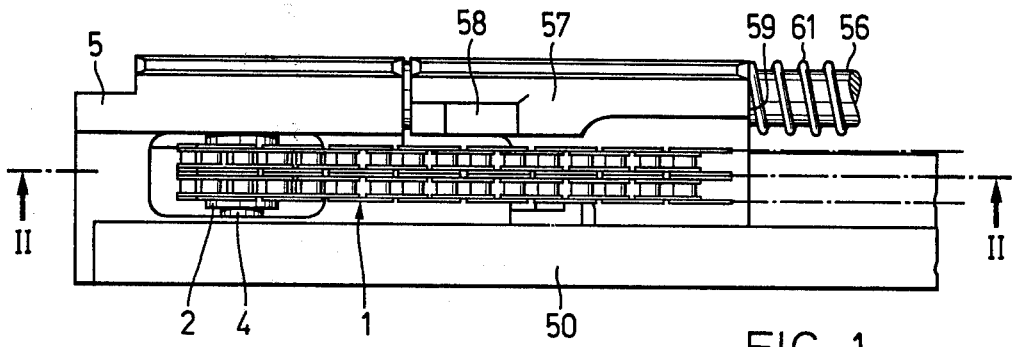
FIG. 1 is an elevational view of a front portion of the manual cocking device or charger according to the invention.
Figure 2:
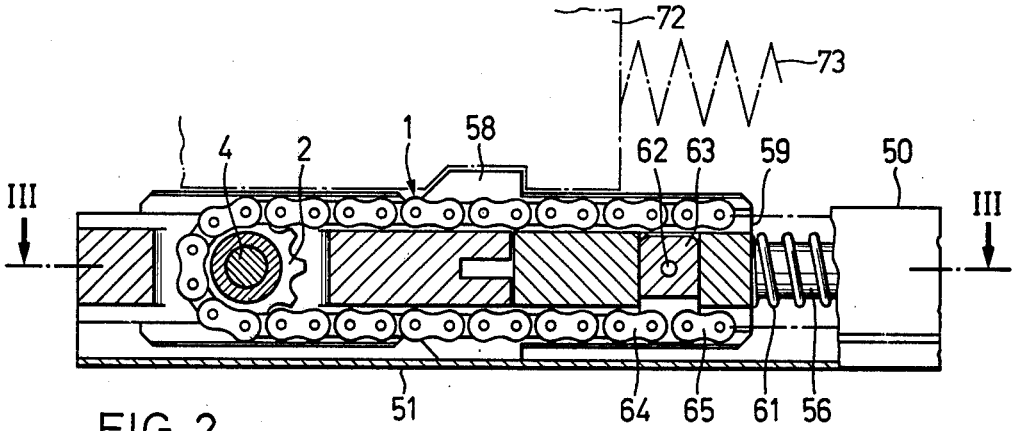
FIG. 2 is a sectional view taken substantially along the line II—II of FIG. 1.

Describing now the drawings, the therein illustrated exemplary embodiment of manual cocking device or charger will be understood as being arranged axially parallel to the axis of an automatic firing weapon in a conventional manner, and thus, not further illustrated herein. According to the showing of FIGS. 1 to 7, this manual cocking device or charger comprises an endless cocking or tensioning chain 1 which engages with two sprocket wheels 2 and 3 or the like. As will be seen in FIG. 3, the front sprocket wheel 2 is mounted to be rotatable in a front deflection housing 5 by means of a shaft 4. According to the showing of FIG. 6, the rear sprocket wheel 3 is rigidly mounted for rotation upon a four-cornered or square shaft 7 which is rotatably mounted in a housing 6. Also mounted for rotation upon the four-cornered or square shaft 7 is a gear 8 which engages with a drive wheel or gear 9 which is operatively connected to a drive shaft 10. The drive shaft 10, which is mounted for rotation in the housing 6, is provided with two four-cornered or square parts 11 and 12. Apart from the drive wheel 9 there is attached to the one four-cornered or square part 11 a locking wheel 15 which is positioned in place by means of an arresting pin 16.or equivalent structure. The shape of the locking wheel 15 can best be seen by referring to FIG. 5. The locking wheel 15 is provided with gear teeth **15*a* having differently pitched or sloped tooth flanks 15*b*, 15*c*. The other four-cornered or square part 12 of the drive shaft 10 is intended for receiving a handcrank 13 which, in the illustration of FIG. 6**, is indicated by dot-dash or phantom lines and serves as a drive means for the manual cocking device or charger.

Figure 6:
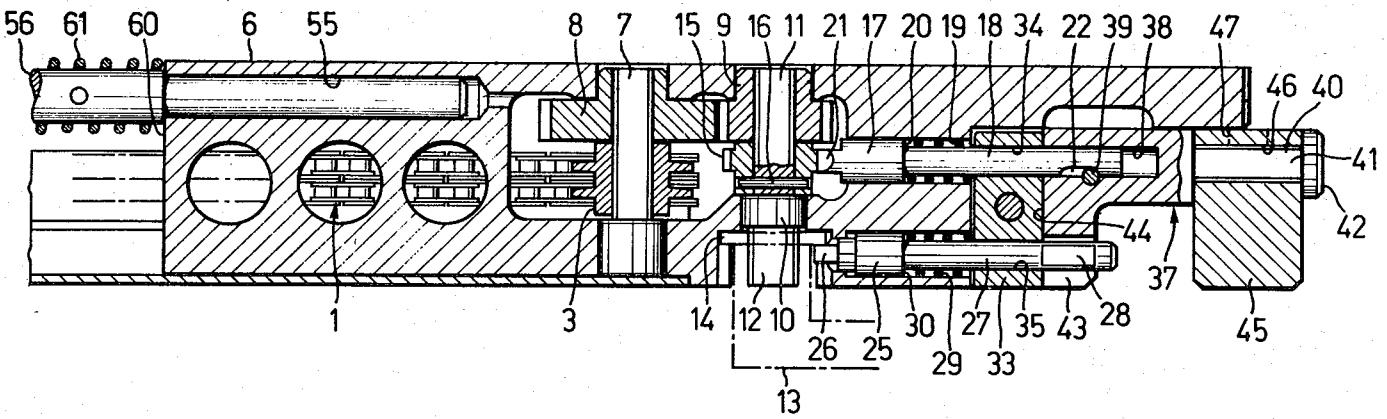
FIG. 6 is a sectional view taken substantially along the line VI—VI of FIG. 5.

Operatively associated with the handcrank 13 is a safety bolt or pin 25, as can best be seen by referring to FIG. 6. This safety bolt 25 is arranged essentially perpendicular to the drive shaft 10 and is mounted in the housing 6 so as to be longitudinally displaceable. By means of a nose 26 or the like provided at the free end of the safety bolt 25 and a flange 14 provided at the handcrank 13 the latter is axially secured to the square part or member 12 of the drive shaft 10.

Operatively associated with the locking wheel 15 is a locking pin or bolt 17 which is mounted so as to be essentially perpendicular to the drive shaft 10, i.e. extends substantially parallel to the safety bolt 25. This locking bolt 17 is mounted in the housing 6 so as to be longitudinally displaceable, as will be evident by referring to FIGS. 5 and 6. A reduced diameter or stepped portion 18 of the locking pin or bolt 17 extends through a bore 34 provided in a housing part or element 33 which can be removed from the housing 6. This reduced diameter portion 18 of the locking bolt 17 also protrudes into a blindhole 38 of a holder or support 37. Around this stepped portion 18 of the locking bolt 17 there is arranged a spring 19 which is supported at one end at a shoulder 20 of the locking bolt 17 and at its opposite end at the housing part or element 33. Furthermore, the locking bolt 17 is provided with a nose 21 which, according to FIG. 5, engages with the teeth 15*a* of the locking wheel 15 and prevents the latter from revolving counterclockwise, while allowing it to revolve in the other direction, i.e. in the drive direction. This is accomplished in that the less steep tooth flanks 15*c* of the locking wheel 15 are capable of causing a short lifting-off or retraction motion of the locking bolt 17 against the biasing force of the spring 19. The stroke or displacement movement of the locking bolt 17 is limited by a depression or slot 22 provided thereat and by a transverse pin 39 which is secured to the holder or support 37.

Figure 4:
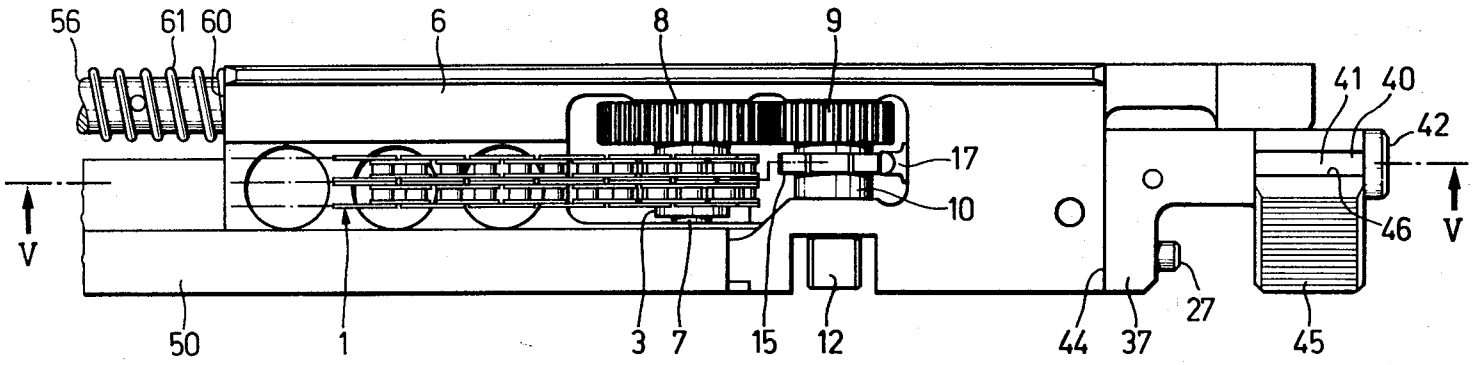
FIG. 4 is an elevational view of a rear portion of the manual cocking device or charger according to the invention.
Figure 5:
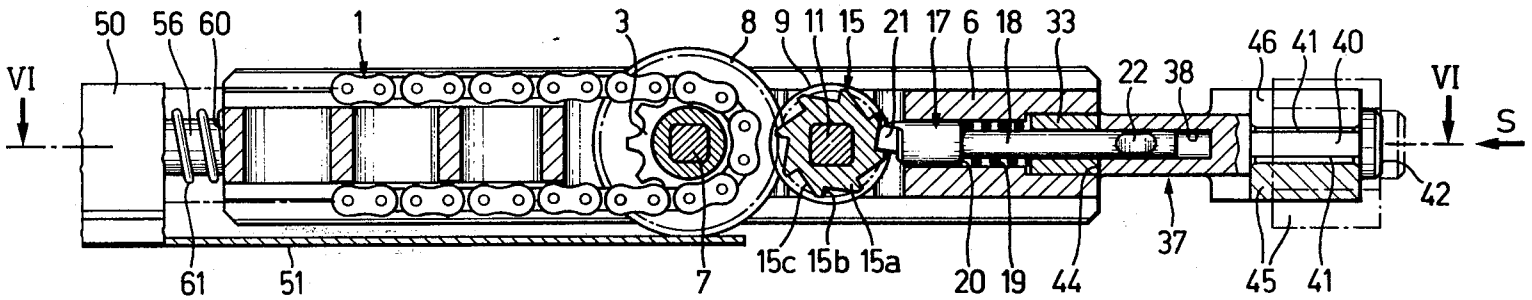
FIG. 5 is a sectional view taken substantially along the line V—V of FIG. 4.

According to the showing of FIGS. 4 to 6, the holder or support 37 comprises a susbtantially cylindrical projection or extension 40 which is provided with two substantially parallel surfaces 41 and closed by a head member 42. Mounted upon the projection 40 of the holder or support 37 is a handle 45 provided with a slot 46 which is offset by 90° with respect to the surfaces 41. The position of the slot 46 prevents the handle 45 from falling out of the mounted position.

According to the showing of FIG. 6, a reduced diameter or stepped portion 27 of the safety bolt 25 is laterally provided with two flat depressions or flats 28 into which engages a substantially fork-shaped part 43 of the holder or support 37. The reduced diameter portion 27 of the safety bolt 25 is surrounded by a spring 29 which is supported at one end at a shoulder 30 of the safety bolt 25 and at the other end at the housing part or element 33. The reduced diameter portion 27 is guided to be longitudinally displaceable through a bore 35 provided in this housing part or element 33.

In the first position illustrated in FIGS. 4 to 6, the holder or support 37 is supported at the housing 6, or more precisely at the housing part or element 33, by means of its front end face or surface 44. At this time the locking bolt 17, which is in axial connection with the holder or support 37, and also the safety bolt 25 are respectively in engagement with the locking wheel 15 and with the handcrank 13. By means of the operating handle 45 the holder or support 37 can be displaced into a second position, wherein the locking bolt 17 is disengaged from the locking wheel 15 by means of the transverse pin 39 and the slot 22, and the safety bolt 25 is disengaged from the handcrank 13 by means of the substantially fork-shaped part or element 43 of the holder or support 37 and the depressions or flats 28. In each instance, such disengagement is accomplished against the action of the related springs 19 and 29, respectively. The holder or support 37 and the locking bolt 17 and the safety bolt 25 can be arrested in this second or rear position by performing a rocking or pivoting movement of the handle 45, which movement has been indicated in FIGS. 5 and 7 by means of dot-dash or phantom lines.

Figure 7:
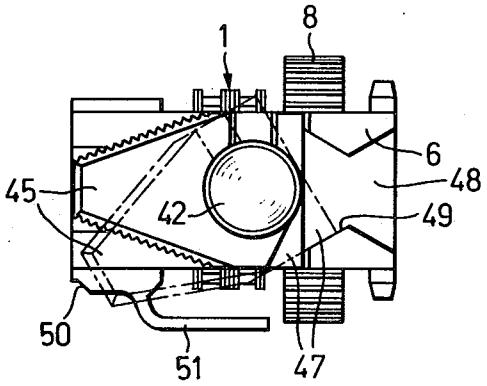
FIG. 7 is a side view of the manual cocking device according to the invention, seen on an enlarged scale looking essentially in the direction of the arrow S of FIG. 5.

Upon accomplishing this pivoting movement an end surface 47 formed at the handle 45, as seen in FIGS. 6 and 7, is shifted behind a rear surface 48 of the housing 6 and the handle 45 is supported at an inclined surface 49 of the housing 6.

Figure 3:
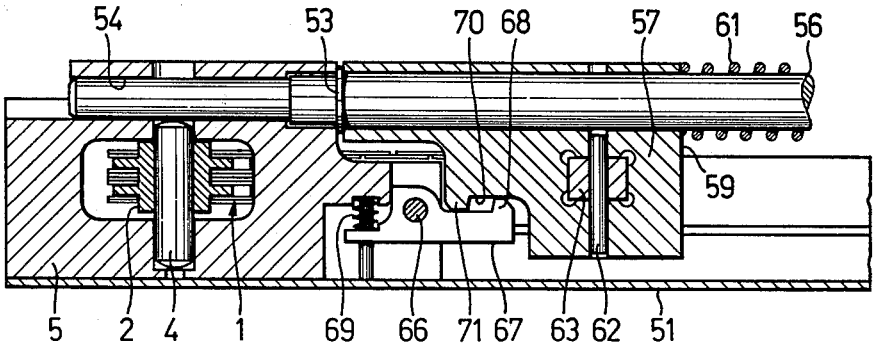
FIG. 3 is a sectional view taken substantially along the line III—III of FIG. 2.

A rod 56 is inserted into a bore 54 of the deflection housing 5, as shown in FIG. 3, and into a bore 55 of the housing 6, as shown in FIG. 6. Guided to be longitudinally displaceable upon this rod 56 is an entrainment element or member 57 which is connected to the cocking or tensioning chain 1. In conventional and therefore not here further illustrated manner the entrainment element 57, as best seen in FIGS. 1 and 3, is in operative connection with breechblock 72 of the weapon by means of its entrainment nose 58, which will be evident by referring to FIGS. 1 and 2. Between a rear wall 59 (FIGS. 1 to 3) of the entrainment element 57 and a front wall 60 (FIGS. 4 to 6) of the housing 6 there is supported a forward advance or counter-recoil spring 61 of the entrainment element 57 and which encircles the rod 56. Between the entrainment element 57 and the front deflection housing 5 there is mounted upon the rod 56 an impact ring 53. By mounting additional ones of these impact rings the initial or starting position can be reestablished if later on in time the cocking or tensioning chain 1 is possibly stretched. The connection of the entrainment element 57 with the cocking chain 1 is accomplished by a bracket 63 or the like which has been shown quite clearly in FIGS. 2 and 3. This bracket 63 is connected to the entrainment element 57 by means of a pin 62 and to the bracket 63 there are secured two chain links 64 and 65 of the cocking or tensioning chain 1, as will be seen in FIG. 2.

A lateral cover 50 is guided at the deflection housing 5 and secured to the housing 6. The lower part or portion 51 of this lateral covering 50 is arranged below the cocking chain 1, as particularly evident by referring to FIG. 7.

According to the showing of FIG. 3 there is arranged at the front deflection housing 5 a locking lever 67 which is pivotable about a pivot pin or shaft 66 and loaded by a spring 69 or equivalent structure. The nose 68 of this locking lever 67 engages into a recess 70 of the entrainment element 57. This entrainment element 57 equally is provided with a catch nose 71 which is arranged forwardly of the recess 70 and closes or limits the same at the front.

From the herein described exemplary construction of the manual cocking device or charger for an automatic firing weapon and designed according to the invention there results the following mode of operation:

Prior to weapon firing the breechblock 72 of the weapon has to be moved into its rear position by means of the herein illustrated manual cocking device or charger and the forward advance or counter-recoil spring 73 of the breechblock of the weapon has to be cocked or tensioned. For this purpose, the drive shaft 10 is rotated in the clockwise sense by means of the handcrank 13 according to FIG. 5. Consequently, the locking bolt 17 is gradually lifted against the action of the spring 19 by means of the less sloped or inclined tooth flanks 15*c* of the locking wheel 15 which co-rotates with the drive shaft 10. The teeth of the locking wheel 15 slide away below the nose 21 of the locking bolt 17. At this time the holder or support 37 equipped with the handle 45 is located in the first position which has been illustrated in FIGS. 4 to 6. The handcrank 13 is secured against falling out, since the nose 26 of the safety bolt 25 is positioned forwardly of the flange 14 of the handcrank 13, as can be seen by referring to FIG. 6. At a favourable transmission ratio the drive wheel 9, which is operatively connected to the drive shaft 10, drives the gear 8 and via the square shaft 7 also the rear sprocket wheel 3 in a counterclockwise rotational sense according to the illustration of FIG. 5 and the cocking or tensioning chain 1 is set into motion. By means of the chain links 64 and 65 and the bracket 63 (FIG. 2) the entrainment element 57 is rearwardly drawn. At the beginning of this movement the catch nose 71 of the entrainment element 57 presses the nose 68 of the locking lever 67 shown in FIG. 3 out of the recess 70 and the locking lever 67 is pivoted out of the way of the entrainment element 57 against the action of the spring 69. By means of the nose 58 of the entrainment element 57 the herein not particularly illustrated breechblock of the weapon and the counter-recoil spring thereof are rearwardly entrained and cocked or tensioned. During this process there must be overcome the force of the forward advance spring 61 and the counter-recoil spring 73 of the breechblock 72. As long as the holder or support 37 is located in the first position, the locking bolt 17 ensures that the forward advance spring 61 and especially the counter-recoil spring 73 of the breechblock 72 cannot move the entrainment element 57 together with the breechblock 72 back to the forward position, even if for any reason the handcrank 13 should be released. The nose 21 of the locking bolt 17 locks the locking wheel 15 in the reverse rotational sense of the drive direction by means of the steeper teeth flanks **15*b* thereof. Thus, a premature forward movement of the breechblock 72** is rendered impossible and a great danger for the operator is eliminated.

When the breechblock 72 has arrived at its rearmost position, where it is caught in conventional and therefore not here further illustrated manner by a trigger pawl, then the entrainment element 57, having fulfilled its function, can be brought back into its front or forward position. By rearwardly displacing the holder or support 37 into its second position by means of the handle 45 and upon possibly arresting the holder or support 37 in this second position by means of the coacting surfaces 47, 48 and 49 at the housing 6, there is annihilated the blocking of the locking wheel 15 in the reverse rotational sense of the drive direction by the locking bolt 17, and the entrainment element 57 can be pressed forward by means of the forward advance spring 61. The forward advance or counter-recoil spring of the breechblock remains cocked or tensioned by virtue of the locking of the breechblock at the trigger and does not participate in the forward advancing movement of the entrainment element 57.

In order to prevent the danger of injury for the gun operator and an unnecessary increase of the inertia mass of the parts to be accelerated, and to ensure that the handcrank 13 is not accelerated and rotationally entrained during the rapid forward advancing movement of the entrainment element 57 and the thus occuring rotation of the drive shaft 10 simultaneous with the retraction of the locking bolt 17 from the locking wheel 15 there also is retracted from the handcrank 13 the safety bolt 25 by means of the holder support 37, and the handcrank 13 is removed.

The entrainment element 57 is again caught in its forward position by the locking lever 67 which acts as a recoil blocking device.

If required, as in the case of an emergency, it also is possible in the arrested position of the handle 45 to slowly forwardly displace the entrainment element 57 together with the breechblock by means of the handcrank 13, for instance for the purpose of eliminating certain defects or disturbances.

While there are shown and described preferred embodiments of the present invention, it is to be distinctly understood that the invention is not limited thereto but may be embodied and practiced within the scope of the following claims. accordingly,

What we claim is:

1. A manual cocking device for an automatic firing weapon, comprising:

a movable entrainment element for retracting a weapon breechblock against the force of a forward advancing means thereof;

a cocking chain for displacing said movable entrainment element;

a sprocket wheel engaging with said cocking chain;

a drive shaft operatively connected to said sprocket wheel;

said drive shaft being capable of actuation by a removable handcrank which drives said drive shaft;

a locking wheel mounted upon said drive shaft;

a spring-loaded locking bolt operatively associated with said locking wheel for blocking the same in one predetermined direction of rotation;

a safety bolt for axially securing said handcrank to said drive shaft; and common holder means for disengaging said locking bolt and said safety bolt from said locking wheel and said handcrank, respectively.

2. The manual cocking device as defined in claim 1, further including:

housing means;

said locking bolt and said safety bolt being mounted to be oriented substantially perpendicular to said drive shaft and longitudinally displaceable in said housing means;

said locking bolt and said safety bolt extending into said holder means and being operatively connected thereto; and said holder means being arranged opposite said housing means and displaceable against spring force.

3. The manual cocking device as defined in claim 2, further including:

a housing part;

said holder means being supported, in a first position thereof, at said housing part;

a handle for displacing said holder means into a second position; and said holder means being arrestable in said second position at a rear surface of the housing means by performing a pivoting movement of said handle.

4. The cocking device as defined in claim 2, wherein:

said locking wheel is provided with teeth having different slope of tooth flanks thereof;

said locking bolt being removable from the less sloped tooth flanks against the force of a spring; and pin and slot means for connecting said locking bolt with said holder means with play.

5. The manual cocking device as defined in claim 2, further including:

a first spring generating part of said spring force and operatively associated with said locking bolt;

a second spring generating at least a further part of said spring force and operatively associated with said safety bolt; and said two springs being supported between a shoulder of their related locking bolt and safety bolt and said housing means.

* * * * *